United States Patent [19]

Ward

[11] 4,308,957

[45] Jan. 5, 1982

[54] DISPENSING CARTON

[75] Inventor: Christine E. Ward, Warrenville, Ill.

[73] Assignee: Container Corporation of America, Chicago, Ill.

[21] Appl. No.: 181,215

[22] Filed: Aug. 25, 1980

[51] Int. Cl.[3] ..... B65D 3/26; B65D 5/70; B65D 75/62

[52] U.S. Cl. ..... 206/626; 229/17 R; 229/38

[58] Field of Search ..... 206/625, 626, 627; 229/17 R, 27, 38

[56] References Cited

U.S. PATENT DOCUMENTS

| | | | |
|---|---|---|---|
| 2,046,562 | 7/1936 | Kane | 229/38 |
| 2,294,964 | 9/1942 | Davidson | 229/17 R |
| 3,315,861 | 4/1967 | Moore | 206/625 |
| 3,724,741 | 4/1973 | Jacobson | 206/626 |
| 4,136,816 | 1/1979 | Gardner | 229/38 |
| 4,169,539 | 10/1979 | Price | 229/38 |

*Primary Examiner*—Herbert F. Ross

*Attorney, Agent, or Firm*—R. W. Carpenter; Davis Chin

[57] ABSTRACT

A folding carton for holding separate products and for dispensing one of the products.

5 Claims, 7 Drawing Figures

DISPENSING CARTON

SUMMARY OF THE INVENTION

This invention relates to folding cartons and more particularly to a dispensing carton adapted to hold two products such as popcorn grain and a packet of salt in separate compartments whereby the grain can be dispensed through an opening in the carton.

It is an object of the invention to provide, in a carton of the type described, a detachable top wall and an insert positioned below the top wall for holding one product and dispensing another product.

These and other objects of the invention will be apparent from an examination of the following description and drawings.

THE DRAWINGS

It will be understood that, for purposes of clarity, certain elements may have been intentionally omitted from certain views where they are belived to be illustrated to better advantage in other views.

DESCRIPTION OF THE INVENTION

Figure 2:
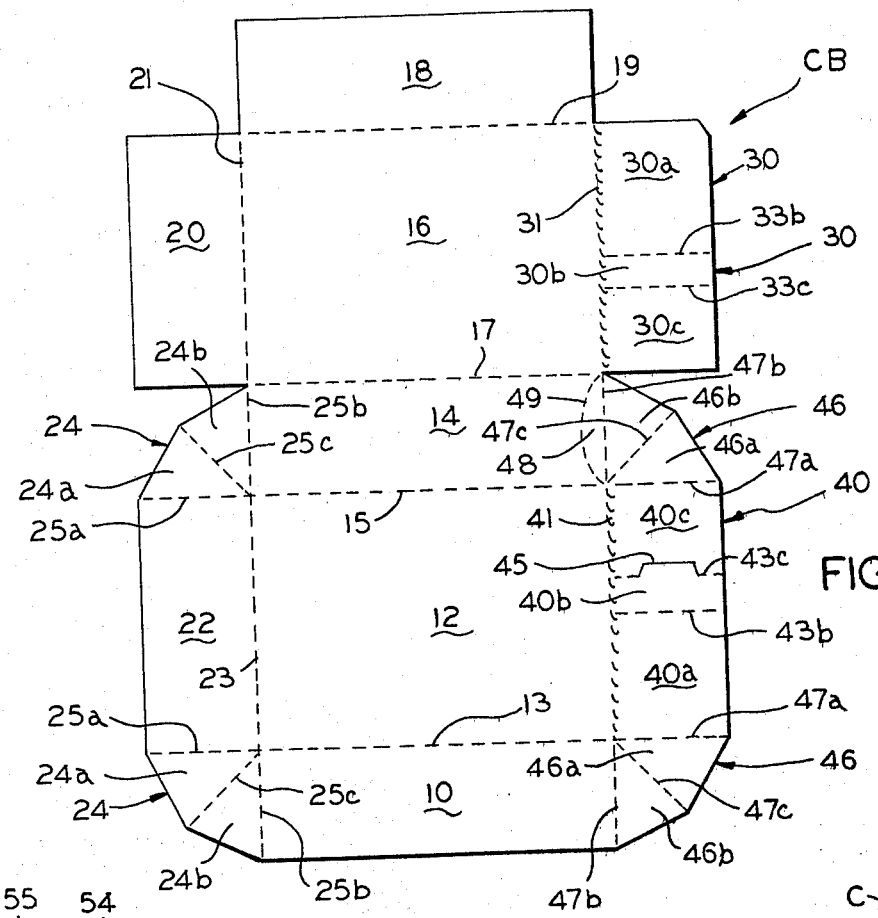
FIG. 2 is a plan view of a blank of foldable sheet material from which the structure of FIG. 1 may be formed.
Figure 1:
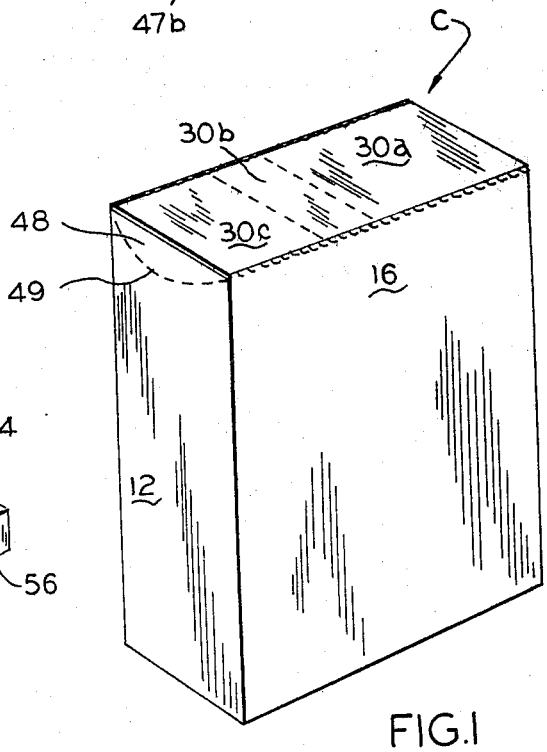
FIG. 1 is a perspective view of a closed carton embodying features of the invention.

Referring now to the drawings of the invention, it will be seen that the carton indicated generally at C illustrated in FIG. 1, may be formed from a unitary blank CB of foldable paperboard illustrated in FIG. 2. The carton also includes a separate insert indicated generally at I and shown in FIG. 3, which may be made from another blank of paperboard indicated generally at IB and shown in FIG. 4.

Carton C, as best seen in FIG. 2, includes a body portion having a first minor side wall panel 10, a first major side wall panel 12, a second minor side wall panel 14, a second major side wall panel 16, and a glue flap 18 which are foldably joined to each other along parallel fold lines 13, 15, 17 and 19, respectively, to form a tubular structure open at the ends with glue flap 18 being adhesively secured to first minor side wall panel 10. At the lower end of the carton the tubular structure is closed by a pair of outer and inner end panels 20 and 22 which are foldably joined along fold lines 21 and 23 to the lower ends of second and first major side wall panels 12 and 16, respectively. Additionally, there may be provided a pair of gusset members 24, each of which includes a pair of generally triangular gusset panels **24*a* and 24*b* which are foldably joined along fold lines 25*a* and 25*b* to the adjacent edges of inner end panel 22 and first and second minor side wall panels 10 and 14, respectively, and to each other along fold line 25*c***.

In order to close the lower end of the carton, the gusset panels of each gusset member 24 are folded in face to face relation with each other, underlying the inner end panel 22, and outer end panel 20 is folded over the inner end panel and secured thereto in overlapped relation.

The closure means for the upper end of the carton includes an outer end panel 30 and an inner end panel 40 which are foldably joined along fold lines 31 and 41 to upper edges of second and first major side wall panels, respectively. Upper outer end panel 30 is divided into three sections, **30*a*, 30*b* and 30*c*, by a pair of fold lines 33*b* and 33*c* which extend parallel to each other and to the side edges of panel 30**.

Likewise, upper inner end panel 40 is divided into three sections, **40*a*, 40*b* and 40*c*, by a pair of fold lines 43*b* and 43*c*, which are aligned with previously mentioned fold lines 33*b* and 33*c*, respectively, of upper outer end panel 30. Center section 40*b* of end panel 40 is provided with an offset or lock tab 45**, the purpose of which is described later in the specification.

Upper inner end panel 40 may also be joined to related minor side wall panels by means of a pair of gusset members 46, each of which includes a pair of generally triangular gusset panels **46*a* and 46*b* which are foldably joined along fold lines 47*a* and 47*b* to end panel 40 and minor side wall panels 10 and 14, respectively, and which are foldably joined to each other on fold line 47*c*. Second minor side wall 14 may be provided with a cut score line 49 which forms at the upper end of panel 14, a half-moon shape push-in tab 48** which facilitates opening of the upper end of the carton.

Figure 4:
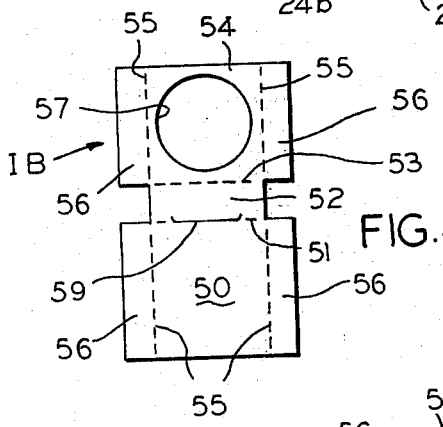
FIG. 4 is a plan view of a blank of sheet material from which the structure of FIG. 3 may be formed.
Figure 3:
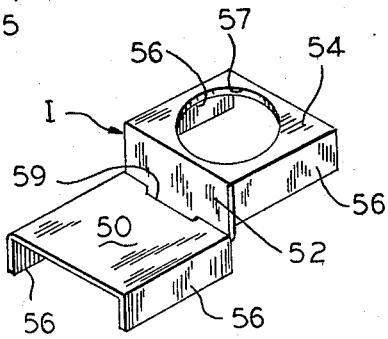
FIG. 3 is a perspective view of an insert for the carton embodying features of the invention.
Figure 6:
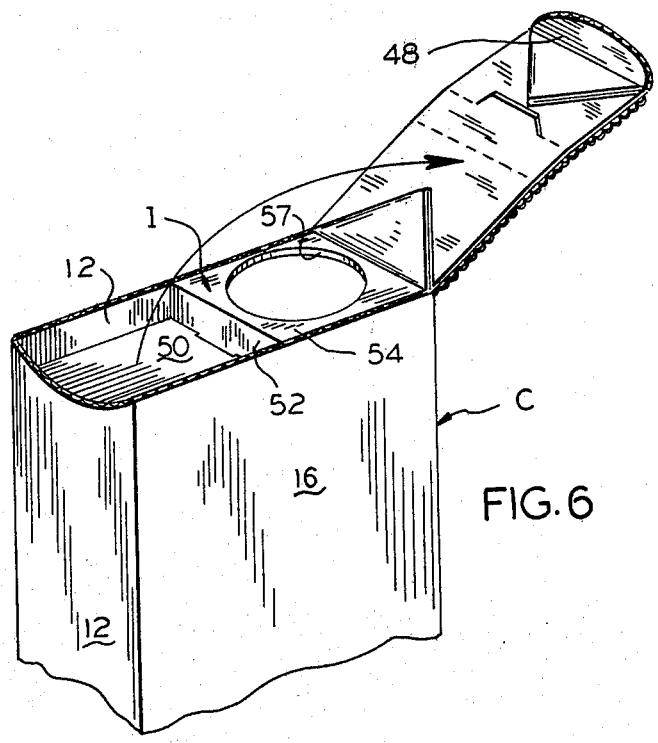
FIG. 6 is a perspective view similar to FIG. 1 but showing the top wall of the carton partially detached for dispensing a product from the carton.
Figure 5:
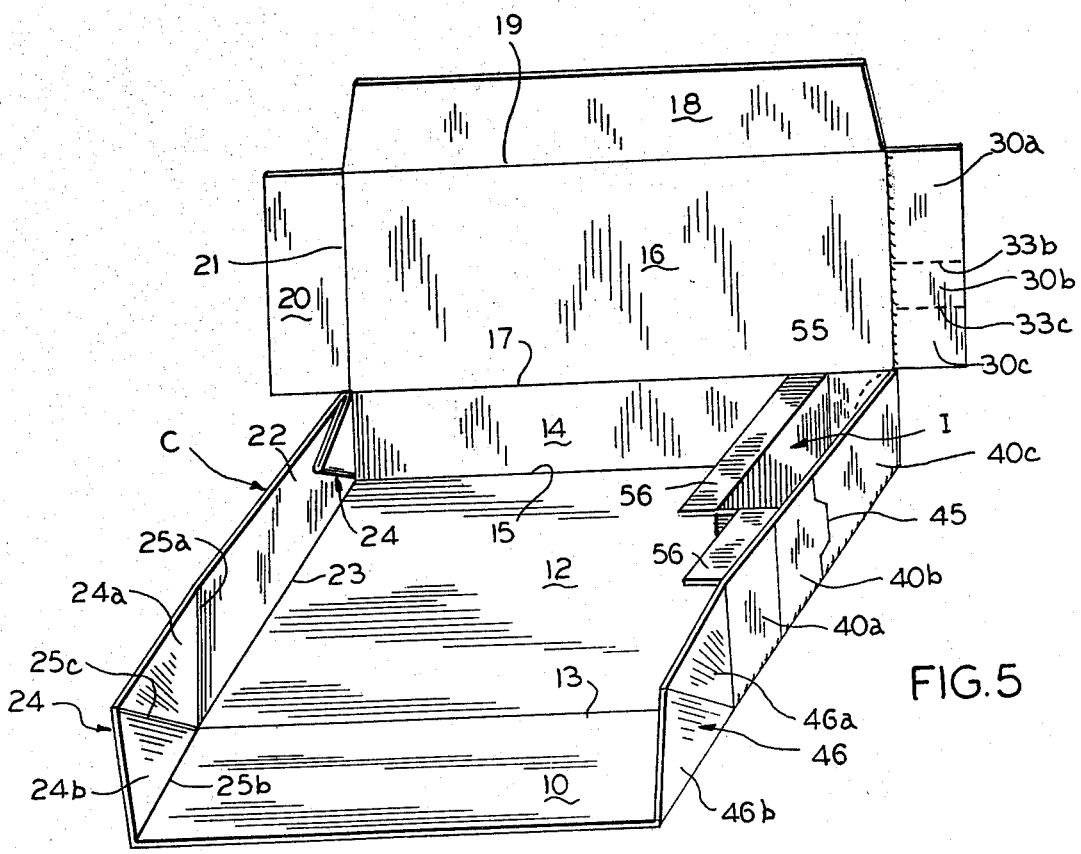
FIG. 5 is a perspective view of the carton shown at one stage of its formation.

Referring now to FIGS. 3 and 4 it will be seen that insert I includes a lower panel 50 and an upper panel 52 which are disposed in parallel planes, one above the other, and which are interconnected by a center panel 54 which is foldably joined at its lower and upper edges along fold lines 51 and 53 to adjacent edges of lower and upper panels 50 and 52, respectively. Each of the panels 50 and 52 is provided with a pair of side glue flaps 56 which are foldably joined to the side edges thereof on fold lines 55 and which depend therefrom. These side glue flaps 56 may be adhesively secured to the inside surfaces of the carton major side walls, as shown in FIG. 6, so that the insert effectively closes off the top portion of the tubular structure, except for an opening 57 in upper panel 52 which permits a product to be dispensed from the carton after the upper end panels have been removed. Also, lower panel 50 may be provided with a cut which forms a slot 59 at the juncture of panel 50 with panel 54, for receipt of lock tab 45 of upper inner end panel 40 upon reclosure. It is contemplated that the carton would be used for holding and dispensing a granular product such as popcorn grains which are dispensed through the opening 57 in the insert I. It will be noted that the lower panel 50 of the insert cooperates with the center panel 54 and adjacent portions of the side walls to form a cavity or recess within which may be placed another product such as a packet of salt.

It will be noted that the fold lines joining the upper panels to three of the carton side walls are cut score type lines or weakening lines of tear which permit upper end panels, which are secured together in overlapped relation, to be detached from the remainder of the carton as shown in FIG. 6.

Figure 7:
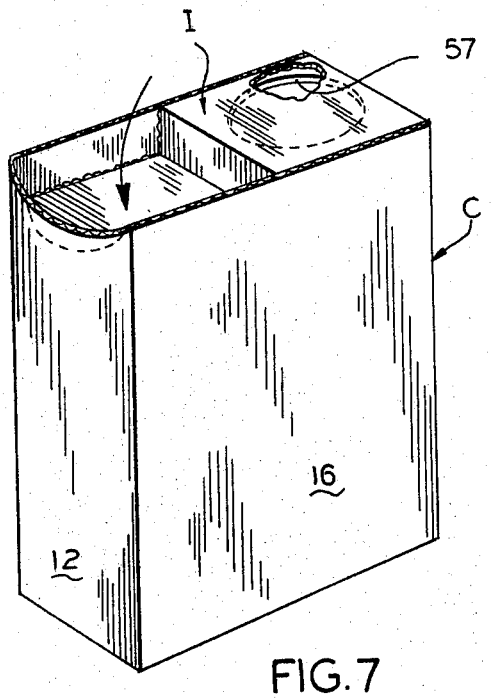
FIG. 7 is a view similar to FIG. 6 but with the top wall folded back to a reclosure position.

In order to reclose the carton the sectionalized upper end panels may be folded downward to the position shown in FIG. 7 where the three sections of the upper end panels are placed in face-to-face relation with insert upper center and lower panels to prevent accidental dispensing of the carton.

I claim:

1. In a carton, formed of foldable sheet material such as paperboard, for holding separate products and for dispensing one of said products, the combination of:

(a) pairs of opposed major and minor side wall panels foldably joined to each other to form a tubular structure open at the ends;

(b) closure means for the lower end of said carton including a pair of outer and inner lower end panels foldably joined to respective major side walls and secured to each other in overlapped relation;

(c) closure and dispensing means for the upper end of said carton including:

(i) a pair of outer and inner end panels detachably joined to certain of side wall panels and secured to each other in overlapped relation;

(ii) an insert secured to upper portions of certain of said side wall panels and extending over the upper end of said tubular structure;

(d) said insert including:

(i) an upper horizontal panel disposed immediately below said upper end panels and presenting an opening for dispensing one product from said carton;

(ii) a lower horizontal panel disposed a short distance below said upper end panels, connected to said upper horizontal panel by a vertical panel, and defining with said vertical panel, said upper end panels, and certain of said side wall panels a cavity for holding another product;

(f) said upper end panels being divided in three sections by a pair of score lines extending parallel to each other and to said minor side wall panels, so that upon reclosure of the carton, after initial opening and removal of said other product from said cavity, said three sections can be folded against said vertical and horizontal panels of said insert.

2. A carton according to claim 1, wherein said upper and lower inner end panels are each joined to adjacent edges of related minor side wall panels by a pair of gusset members, each of which includes a pair of gusset panels foldably joined to an inner end panel, a minor side wall panel, and to each other.

3. A carton according to claim 1, wherein one of said upper inner end panel sections has projecting therefrom a lock tab which is receivable within an opening in said insert lower panel upon reclosure of the carton.

4. A carton according to claim 2, wheren said upper end panels are secured to the related gusset members and to each other to provide an integral, partially detachable top wall for the carton.

5. A carton according to claim 4, wherein one of said minor side walls includes a detachable upper portion which is foldably joined to an end of said upper end panels for detachment therewith when the carton is opened.

* * * * *